US005205598A

United States Patent [19]

Miller

[11] Patent Number: 5,205,598

[45] Date of Patent: Apr. 27, 1993

[54] MULTIPLE-OBJECT GRASPING DEVICE

[76] Inventor: Wallace B. Miller, 17365 Caminito Caldo, San Diego, Calif. 92127

[21] Appl. No.: 925,341

[22] Filed: Jun. 22, 1992

[51] Int. Cl.[5] ..... A63B 47/00

[52] U.S. Cl. ..... 294/19.2; 273/32.5; 294/24

[58] Field of Search ..... 294/11, 19.1, 19.2, 294/22-24, 50.8, 50.9, 104, 902; 248/96; 273/32 A, 32 B, 32 F, 32.5, 162 C-162 F

[56] References Cited

U.S. PATENT DOCUMENTS

| | | | |
|---|---|---|---|
| 2,642,796 | 6/1953 | La Bore | 294/19.1 X |
| 2,759,758 | 8/1956 | Yancey | 294/19.1 X |
| 4,013,295 | 3/1977 | Baughman | 294/19.2 X |
| 4,231,603 | 11/1980 | Van Zelm | 294/19.1 |
| 4,526,369 | 7/1985 | Phelps | 294/19.2 X |
| 4,616,826 | 10/1986 | Trefts | 294/19.2 X |
| 4,714,250 | 12/1987 | Henthorn | 294/19.2 X |
| 4,819,938 | 4/1989 | Hill | 294/19.2 X |
| 4,949,961 | 8/1990 | Milano | 294/19.2 X |
| 5,080,357 | 1/1992 | Wolf | 294/19.2 X |

FOREIGN PATENT DOCUMENTS

| | | | |
|---|---|---|---|
| 849366 | 9/1960 | United Kingdom | 294/19.1 |

*Primary Examiner*—Johnny D. Cherry
*Attorney, Agent, or Firm*—Ralph E. Walters

[57] ABSTRACT

The present invention relates to a multiple-object grasping device providing an elongated channel-like body and a pivotally connected object grasping arm each of which has a stepped or undercut object-receiving notch thus cooperatively to accommodate a golf ball and tee in proper interrelationship for simultaneous installation on a teeing area of a golf course and which is just as conveniently adapted individually to handle these and other golf playing accessories coincident with a round of golf while the golfer is permitted to maintain a substantially upright position without the necessity of ever having to stoop or bend over. The body has a pair of object engaging fingers between which a finger on the arm is extendable to dependably grasp such objects and to hold them in tightly stacked relation. The present subject invention virtually eliminates any possibility of damage to the golf hole by further providing a spring tensioned grasping arm which affords a self-centering effect as it expands in sliding relation against the inner wall of the cup to effectively maintain the device in upright substantially vertical position spaced from the vulnerable upper rim or edge of the cup.

8 Claims, 1 Drawing Sheet

MULTIPLE-OBJECT GRASPING DEVICE

TECHNICAL FIELD

The present invention relates to a multiple-object grasping device for partially infirmed persons who have difficulty stooping or bending to deposit or retrieve objects on or near the ground; and more particularly to such a device which is capable of gripping multiple items such as a golf ball and a tee together in proper interrelationship for installation as a unit on a golf course teeing area or alternatively for handling each object separately during a round of golf.

BACKGROUND ART

Heretofore, the only aid for golfers, who have difficulty bending their lower extremities to deposit or retrieve objects on or near the ground, has been the use of a suction cup installed on the end of a putter grip. These are primarily used, however, for retrieving the ball from the bottom of a cup or hole on the greens. Obviously, the suction cup is not readily adaptable for use in the many other similar maneuvers necessary during a round of golf, such as marking the ball on the green and teeing it up on the teeing area. Even when used as intended, the suction cup may cause more problems than it solves. In use, the suction cup is pressed downwardly against the ball in the bottom of the cup. Frequently, this is achieved only with some difficulty because of the inability to properly align the putter shaft with the ball for complete seating of the suction cup in proper grasping conforming relation to the surface of the ball. In attempting such engagement, the putter shaft frequently comes in contact with the upper edge or rim of the hole above the cup. Such contact causes the rim to be slightly raised or otherwise damaged, to the great consternation of subsequent golfers whose putts are sometimes missed by deflection of the balls away from the hole by such deformed lip. As a result, there has been some movement to outlaw such suction cups from play on some golf courses.

The greater problem for the partially infirmed golfer occurs on the teeing area of the course. Normally, the ball and tee are held together in the golfer's hand with two fingers disposed on opposite sides of the tee holding it against the ball. The tee and ball are then installed together on the teeing area by the golfer bending over to exert a downward force upon the top of the ball, which is translated through the tee for penetration into the ground. After striking the ball from the tee, the latter is usually retrieved from the ground for use at the next teeing area. These movements require some flexibility in the legs and hips which are just impossible for some golfers who otherwise are able to play, compete, and enjoy the game of golf. It is therefore recognized that an improved device for simultaneously grasping a golf ball and tee in proper interrelationship for installation on a teeing area without requiring any bending movement by the golfer is highly desirable. It is further desirable that the device also be adaptable for use in the multitude of similar situations on the course involving individual manipulation of the ball, tee, ball markers and any other accessory employed during a round of golf. Accordingly, the present invention is directed to overcoming the problems as set forth above.

DISCLOSURE OF THE INVENTION

In accordance with one aspect of the present invention, there is provided an elongated multiple-object grasping device having a hand gripping and actuating end and an oppositely extended object grasping end providing a stepped object receiving notched object engaging arm pivotally mounted thereon adapted to hold one object against another in intimately contacting predetermined interrelationship within the device until simultaneous release of both objects by manipulation of the hand gripping end thereof.

BEST MODE FOR CARRYING OUT THE INVENTION

Figures 1, 2, 3, 4, 5:
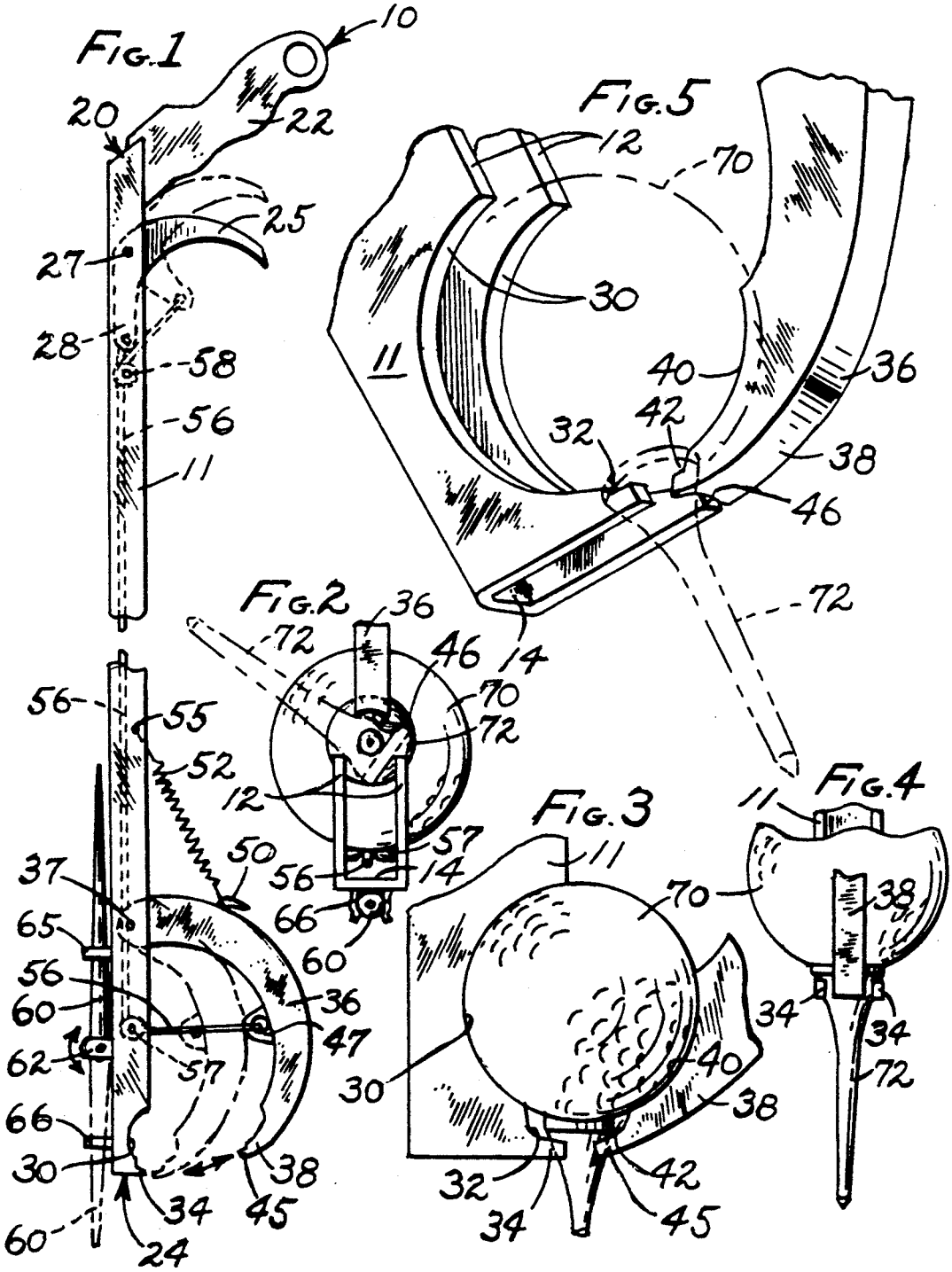
FIG. 1 is a side elevational view of the multiple-object grasping device of the present invention shown in an open full line position and a closed grasping position in broken lines.
FIG. 2 is a somewhat enlarged fragmentary bottom or end view of the multiple-object grasping device of FIG. 1 in grasping relation to a golf ball and tee, and also showing an alternative tee position in broken lines depicting the tee being grasped from a horizontal position lying on the ground.
FIG. 3 is a further enlarged fragmentary side elevation with the grasping end of the present invention and the golf ball and tee shown approximately full size.
FIG. 4 is a front elevational view of the grasping end of the present invention.
FIG. 5 is a further enlarged three dimensional view of the grasping end of the present invention with the golf ball and tee shown in broken lines.

Referring more particularly to FIG. 1 of the drawings, a multiple-object grasping device embodying the principles of the present invention is generally designated by the reference numeral 10. The grasping device has an elongated channel-like body 11 having a substantially U-shaped cross section providing oppositely spaced substantially parallel side rails 12 interconnected by an integral bight or back portion 14.

Grasping device 10 further provides a hand gripping end 20 having a pistol-type grip 22 rigidly connected to the body 11 and an opposite object gripping end 24. A trigger 25 is pivotally mounted between the side rails 12 on a pin 27 and has an inner end 28 normally disposed between the side rails 12 when the device 10 is in the full line open position of FIG. 1. The grasping end 24 has an arcuately shaped main notch 30 in each of the side rails 12 which notches are preferably approximately one-half the circumference of a standard golf ball. Each notch has an undercut 32 formed therein closely adjacent to the end of their respective rails to form a pair of slightly outwardly tapering fingers 34.

An arcuately curved object grasping arm 36 is pivotally mounted on a pivot pin 37 between the side rails 12 at the grasping end 24 of the grasping device 10. The arm has an opposite distal end 38 which includes an arcuate notch 40 approximately conforming to a one-quarter segment of the circumference of a golf ball. The notch has an undercut portion 42 which forms an outwardly tapering finger 45 on the arm having a width somewhat less than the space between the fingers 34 of the rails 12. The finger has a concave nose portion 46 which is arcuately curved in substantially conforming relation to the curvature of the shank of a golf tee beneath the head portion thereof. An inner tab 47 is extended from the arm substantially midway between its ends. An integral hook 50 is also formed on the opposite side of the arm in closely spaced relation from the pivot pin 37 adjacent to the body 11. A tension spring 52 is attached at one end to the hook 50 and is secured at its opposite end to the body by a pin 55. An elongated flexible cable or line 56 is connected at one end to the tab 47 of the arm, then trained over pulleys 57 and 58 in the body for connection at its opposite end to the inner end 28 of the trigger 25.

As shown in FIG. 1 of the drawings, a support spike 60 is pivotally mounted on a pair of pivot legs 62 on the back 14 of the body 11 for selectively manual swinging movement between an upwardly disposed carry or storage position, shown in full lines, and a downwardly extended support position shown in broken lines. The spike is firmly releasably held in each of these positions by a pair of friction catches 65 and 66, which are mounted on the body in spaced relation respectively above and below pivot legs 62.

INDUSTRIAL APPLICABILITY

The multiple-object grasping device 10 of the present invention is particularly adapted for use with a standard golf ball and tee designated by the reference numerals 70 and 72, respectively. Prior to use, the grasping arm 36 of the device is disposed in its open full line position of FIG. 1 by the tension spring 52. With the body 11 held in one hand of the golfer in a substantially horizontal orientation, a golf ball 70 is deposited into the ball receiving notch 30 in craddling relation between the side rails 12.

The head of the tee 72 is then inserted into the undercut 32 between the side rails 12 by the golfer's other hand. It is noted that at this time the longitudinally tapered surface of the tee beneath the head slidably engages the fingers 34 which position can be easily maintained by the fingers of the golfer's first mentioned hand supporting the body 11. The golfer's other hand is thus free to then grasp the opposite hand gripping end 20 of the device 10 for manipulation of the trigger 25. Squeezing of the trigger toward the grip 22 or broken line position of FIG. 1 causes upward linear travel of the line 56 to pivotally swing the grasping arm 36 inwardly toward its closed ball retaining position.

At this time the arcuate ball engaging notch 40 in the grasping arm 36 will engage the curved surface of the ball 70 dependably to capture and hold it within the main ball receiving notch 30. Simultaneously, the nose 46 of the finger 45 on the arm engages the longitudinally tapered surface beneath the head of the tee in opposed relation to the fingers 34 on the body 11. With continued pressure applied through the trigger 25, line 56 and arm 36, the tee is cammed or slidably actuated upwardly by the described engagement of the nose of the finger 45 with the tapered surface of the tee. Such movement causes the head of the tee to tightly engage the adjacent surface of the ball in stacked relation and to provide a force through the ball against the opposing surfaces of the main ball receiving notch 30 in the rails 12. Accordingly, as long as the pressure is maintained on the trigger 25, the golf ball and tee are held in their described preferred interrelationship as best shown in FIG. 5 for subsequent installation on the teeing area of the course. This is accomplished with one hand by the golfer who merely points the device in hovering relation above the desired spot on the tee and by exerting sufficient force against the grip 22 causes the tee to penetrate the ground. The trigger is then released and the ball grasping arm 36 is automatically swung to its outwardly disposed open position by spring 52, permitting the ball to be released from the main ball grasping notch 30 in position on the tee for being struck by a golf club. If for some reason the ball is not teed correctly on such first installation, the ball and tee can be easily regripped together by repeating the above described operation to either raise or lower the ball or move it to a completely new location on the tee.

After hitting the golf ball 70 from the tee 72, the tee can be easily retrieved with the grasping device 10 of the present invention without requiring any bending or stooping movement by the golfer. If the tee remains in its original upright teeing position, the grasping arm is conveniently manipulated as previously described to engage the head of the tee which is removed from the ground by an upward pulling movement on the gripping end 20 of the device. It should be noted that only a very light squeezing force on the trigger 25 is necessary to grip the relatively lightweight tee in the absence of the golf ball from the prior assembly. In this way the aforedescribed camming movement of the tee relative to the grasping fingers 34 and 45 is greatly minimized insuring against upward separation of the tee from the device as it is elevated to a position for removal from the device 10 by the other hand of the golfer.

More frequently, when the ball is struck from the tee it will be displaced and lying in a horizontal position upon the ground. In this position the head end of the tee is in an excellent orientation for being tightly wedged between the fingers 34 by the finger 45 upon squeezing the trigger 25, as shown in the broken lines of FIG. 2. This will automatically occur since the tee will be rotated slightly by its engagement during such clamping action of the finger 45 of arm 36 as it moves toward the body 11. Nearly any object can be grabbed or handled irrespective of its shape so long as it is smaller than the width of the maximum open position of the arm 36 and body 11. Ball markers and coins can also be readily manipulated between deposited and retrieved positions relative to the ground during a round of golf in the same manner as the aforedescribed tees. After deposit, the marker can be tapped down by using the lower outer surface of the grasping arm 36.

In any of the above game situations, the device 10 of the present invention can be temporarily set aside in a convenient position for immediate further use by employing the spike assembly 60. After depositing the ball and tee or marker, the spike is released from its upper friction catch 65 and swung downwardly for engagement with the lower friction catch 66 to its outwardly extended support position as shown in broken lines in FIG. 1. The spike is then inserted into the ground thus holding the device 10 in an upright out of way position on the tee or green while the ball is being struck. After completion of the stroke, the device 10 can be lifted and the spike returned to its upwardly disposed noninterfering carry position.

It is readily apparent that the device 10 of the present invention may even be utilized to retrieve a golf ball from the below-ground position within the cup. Unlike the former suction cup attachment on the putter grip, the device 10 is substantially self-centering as it is being lowered into the cup by the tension spring 52 causing the outer surface of the grasping arm 36 to be urged outwardly into sliding engagement with the cup to help keep the body 11 in an upright substantially vertical position both during insertion and withdrawal from the hole. This then virtually eliminates the possibility of any undesirable engagement and deleterious effect upon the rim or upper edge of the hole as frequently occurs with the aforementioned suction cups.

Accordingly, in view of the foregoing it should be recognized that the present invention provides an improved multiple-object grasping device 10 which enables a golf ball, tee or other accessories to be handled either in proper interrelationship with each other or individually manipulated in virtually any situation during a round of golf without requiring the golfer to stoop or bend over and to effectively achieve such results with virtually no possibility of damage to the golf course during its proper use.

I claim:

1. A multiple-object grasping device comprising;

an elongated body having a pair of spaced side rails providing a hand gripping and actuating end, and an opposite object gripping end having a pair of congruently related object receiving notches with a pair of object gripping fingers individually adjacent thereto;

an object grasping arm pivotally mounted on said body adjacent to said object gripping end thereof having operating connection to said hand gripping and actuating end, and providing an object engaging notch disposable in opposing relation to said notches in said side rails of the body, and an object gripping finger disposed in closely spaced adjacent relation to its object engaging notch which is extendable between said fingers of the side rails;

and an undercut portion between said object receiving and object engaging notches and their respectively adjacent fingers for accommodating a second object therein adjacent to the first.

2. The multiple-object grasping device of claim 1 in which said object receiving and engaging notches are arcuately curved to embrace in conforming relation the surface of a golf ball;

and said undercut portions are of a combined size larger than the head of a golf tee to permit engagement of said fingers with the tapered shank portion of the tee.

3. The multiple-object grasping device of claim 2 wherein the spacing of said fingers on the side rails of the body are less than the diameter of the head of said golf tee.

4. The multiple-object grasping device of claim 3 wherein said finger of the object grasping arm has a concave nose portion which is arcuately curved in corresponding relation to the curved shank portion of a golf tee.

5. The multiple-object grasping device of claim 4 in which said body includes a bight portion between said side rails; and an elongated pointed spike pivotally mounted on said bight portion of the body, and latch means disposed in longitudinally spaced relation on said bight portion for selectively receiving said spike in releasable locking relation in opposite carry and support positions.

6. A multiple-object grasping device, for a golf ball and tee with the ball having a predetermined circumference and with the tee having a head portion of a predetermined diameter and an extended tapering shank;

an elongated body having a piston grip end and an opposite object grasping end, a trigger pivotally mounted on said body adjacent to said grip, an arcuately curved object grasping arm having a nose portion of predetermined width, pivotally mounted on said object grasping end of the body, a tension spring connected between said arm and said body, an elongated flexible line threaded through said body in interconnecting relation between said grasping arm and said trigger;

said body having a U-shaped cross-section providing a pair of side rails spaced apart a distance slightly farther than the width of said nose portion of the grasping arm for movement of the arm in opening and closing relation relative to said grasping end of the body upon actuation of said trigger;

the improvement comprising a pair of congruently related golf ball receiving notches formed in said side rails at said grasping end of the body which substantially conforms to approximately one-half the circumference of a golf ball;

and a golf ball engaging notch formed in said object grasping arm adjacent to said nose portion thereof which substantially conforms to approximately one quarter the circumference of a golf ball being disposable in opposing ball capturing relation to said notches in the body; and undercut portions provided adjacent to said notches on the body and the arm providing a tee head accommodating and retaining space when said arm is in its close object grasping position relative to the body.

7. The multiple-object grasping device of claim 6 wherein said undercut portions of said body provides a pair of spaced fingers between which the tapered shank of the tee can be tightly wedged;

and said nose portion of said grasping arm forming a finger for engagement with the tee to urge the tee into said wedging relation with said fingers on the body.

8. The multiple-object grasping device of claim 7 in which said finger of the nose portion of said grasping arm is arcuately curved in substantially conforming relation to said tapered shank portion of the tee.

* * * * *